US006964322B2

(12) United States Patent
Green et al.

(10) Patent No.: US 6,964,322 B2
(45) Date of Patent: Nov. 15, 2005

(54) METHOD AND APPARATUS FOR SYNCHRONIZING A VEHICLE LIFT

(75) Inventors: Steven D. Green, Madison, IN (US); David P. Porter, Madison, IN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 20 days.

(21) Appl. No.: 10/788,119

(22) Filed: Feb. 26, 2004

(65) Prior Publication Data

US 2004/0163894 A1 Aug. 26, 2004

Related U.S. Application Data

(62) Division of application No. 10/123,083, filed on Apr. 12, 2002, now Pat. No. 6,763,916.

(51) Int. Cl.[7] ..... B66B 1/28

(52) U.S. Cl. ..... 187/285; 187/203; 91/522; 91/530

(58) Field of Search ..... 187/203, 209, 187/224, 274, 285, 287, 282, 286; 60/484, 487, 491; 91/509–518, 521–523, 532

(56) References Cited

U.S. PATENT DOCUMENTS

| | | | | |
|---|---|---|---|---|
| 2,201,189 A | * | 5/1940 | Makaroff et al. | 254/91 |
| 2,891,765 A | | 6/1959 | Pearne | |
| 2,942,848 A | | 6/1960 | Friesen | |
| 2,984,072 A | | 5/1961 | Born | |
| 3,265,357 A | | 8/1966 | Schilling | |
| 3,289,868 A | | 12/1966 | Miller et al. | |
| 3,377,924 A | | 4/1968 | Spencer | |
| 3,556,480 A | | 1/1971 | Johansson | |
| 3,638,535 A | | 2/1972 | Ponter | |
| 3,750,899 A | * | 8/1973 | Greer | 414/240 |
| 3,757,899 A | | 9/1973 | Smith, Jr. | |
| 3,769,881 A | * | 11/1973 | Aoki | 91/171 |
| 3,967,701 A | | 7/1976 | Hegenbart | |
| 3,968,730 A | | 7/1976 | Lionet | |
| 4,230,304 A | | 10/1980 | Tol | |
| 4,241,581 A | * | 12/1980 | Chace | 60/538 |
| 4,241,901 A | | 12/1980 | Shircliffe | |
| 4,679,489 A | | 7/1987 | Jasinski et al. | |
| 4,706,458 A | | 11/1987 | Corghi | |
| 4,777,798 A | | 10/1988 | Jacobson et al. | |
| 5,012,898 A | * | 5/1991 | Tsymberov | 187/208 |
| 5,024,141 A | | 6/1991 | Kawada | |
| 5,050,844 A | | 9/1991 | Hawk | |
| 5,065,844 A | | 11/1991 | Hon | |
| 5,199,686 A | | 4/1993 | Fletcher | |
| 5,299,658 A | | 4/1994 | Cox et al. | |
| 5,597,987 A | * | 1/1997 | Gilliland et al. | 187/285 |
| 5,740,886 A | | 4/1998 | Fletcher | |
| 5,860,491 A | | 1/1999 | Fletcher | |
| 6,186,280 B1 | * | 2/2001 | Healy | 187/207 |
| 6,189,432 B1 | | 2/2001 | Colarelli et al. | |
| 6,321,634 B1 | * | 11/2001 | Yeo et al. | 91/515 |

FOREIGN PATENT DOCUMENTS

| | | |
|---|---|---|
| DE | 3433136 | 9/1984 |
| JP | 03166199 | 7/1991 |
| WO | WO 95/11189 | 4/1995 |

* cited by examiner

*Primary Examiner*—Jonathan Salata
(74) *Attorney, Agent, or Firm*—Frost Brown Todd LLC

(57) ABSTRACT

A vehicle lift control maintains multiple points of a lift system within the same horizontal plane during vertical movement of the lift engagement structure by synchronizing the movement thereof. A vertical trajectory is compared to actual positions to generate a raise signal. A position synchronization circuit synchronizes the vertical actuation of the moveable lift components by determining a proportional-integral error signal.

6 Claims, 7 Drawing Sheets

METHOD AND APPARATUS FOR SYNCHRONIZING A VEHICLE LIFT

This application is a divisional application of U.S. patent application Ser. No. 10/123,083, filed Apr. 12, 2002, now U.S. Pat. No. 6,763,916 the disclosure of which is incorporated herein by reference. This application hereby incorporates by reference U.S. patent application Ser. No. 10/055,800, filed Oct. 26, 2001, titled Electronically Controlled Vehicle Lift And Vehicle Service System and U.S. Provisional Application Ser. No. 60/243,827, filed Oct. 27, 2000, titled Lift With Controls, both of which are commonly owned herewith.

BACKGROUND OF THE INVENTION

This invention relates generally to vehicle lifts and their controls, and more particularly to a vehicle lift control adapted for maintaining multiple points of a lift system within the same horizontal plane during vertical movement of the lift superstructure by synchronizing the movement thereof. The invention is disclosed in conjunction with a hydraulic fluid control system, although equally applicable to an electrically actuated system.

There are a variety of vehicle lift types which have more than one independent vertically movable superstructure. Examples of such lifts are those commonly referred to as two post and four post lifts. Other examples of such lifts include parallelogram lifts, scissors lifts and portable lifts. The movement of the superstructure may be linear or non-linear, and may have a horizontal motion component in addition to the vertical movement component. As defined by the Automotive Lift Institute ALI ALCTV-1998 standards, the types of vehicle lift superstructures include frame engaging type, axle engaging type, roll on/drive on type and fork type. As used herein, superstructure includes all vehicle lifting interfaces between the lifting apparatus and the vehicle, of any configuration now known or later developed.

Such lifts include respective actuators for each independently moveable superstructure to effect the vertical movement. Although typically the actuators are hydraulic, electromechanical actuators, such as a screw type, are also used.

Various factors affect the vertical movement of superstructures, such as unequal loading, wear, and inherent differences in the actuators, such as hydraulic components for hydraulically actuated lifts. Differences in the respective vertical positions of the independently superstructures can pose significant problems. Synchronizing the vertical movement of each superstructure in order to maintain them in the same horizontal plane requires precisely controlling each respective actuator relative to the others to match the vertical movements, despite the differences which exist between each respective actuator.

BRIEF DESCRIPTION OF THE DRAWING

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE INVENTION

Figure 1:
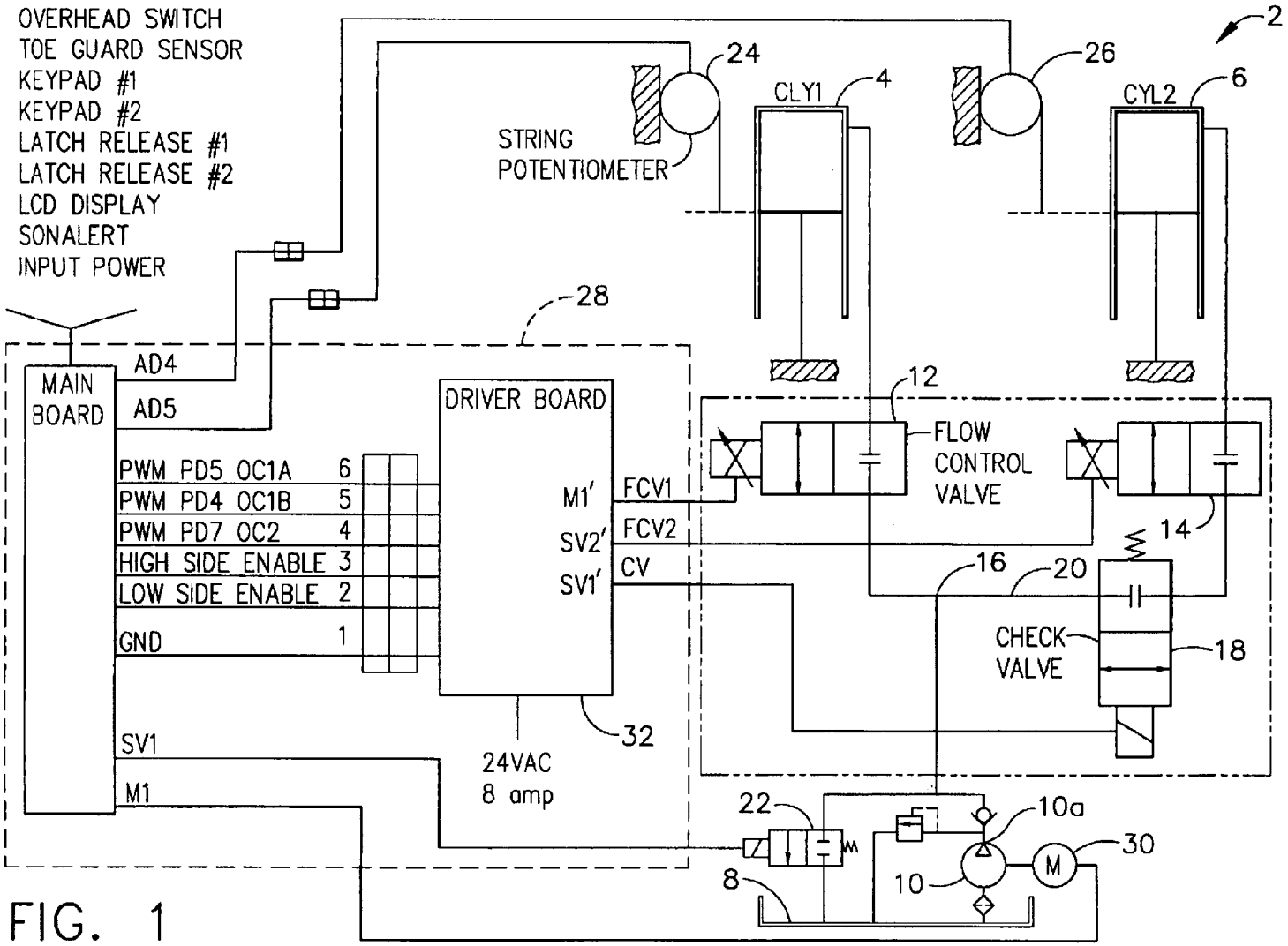
FIG. 1 is a schematic diagram of an embodiment of a control in accordance with the present invention, embodied as a hydraulic fluid control system including the controller and hydraulic circuit.

Referring now to the drawings in detail, wherein like numerals indicate the same elements throughout the views, FIG. 1 illustrates a vehicle lift, generally indicated at 2. Lift 2 is illustrated as a two post lift, including a pair of independently moveable actuators 4 and 6 which cause the respective superstructures (not shown) to move. In the depicted embodiment, first and second actuators 4 and 6 are illustrated as respective hydraulic cylinders, although they may be any actuator suitable for the control system. First and second actuators 4 and 6 are in fluid communication with a source of hydraulic fluid 8. Pressurized hydraulic fluid is provided by pump 10 at discharge 10*a*. Each actuator 4 and 6 has a respective proportional flow control valve 12 and 14 interposed between its actuator and source of hydraulic fluid 8.

The hydraulic fluid flow is divided at 16, with a portion of the flow going to (from, when lowered) each respective actuator 4 and 6 as controlled by first and second proportional flow control valves 12 and 14. As illustrated, isolation check valve 18 is located in the hydraulic line of either actuator 4 or 6 (shown in FIG. 1 in hydraulic line 20 of actuator 6), between 16 and second flow control valve 14 to prevent potential leakage from either actuator 4 or 6 through the respective flow control valve 12 and 14 from affecting the position of the other actuator.

Isolation check valve 18 can be eliminated if significant leakage through first and second flow control valves 12 and 14 does not occur. In the embodiment depicted, equalizing the hydraulic losses between 16 and actuator 4, and 16 and actuator 6, makes it easier to set gain factors (described below). To achieve this, an additional restriction may be included in hydraulic line 20*a* between 16 and actuator 4 to duplicate the hydraulic loss between 16 and actuator 6, which includes isolation check valve 18. This may be accomplished in many ways, such as through the addition of an orifice (not shown) or another isolation check valve (not shown) between 16 and actuator 4.

The hydraulic circuit includes lowering control valve 22 which is closed except when the superstructures are being lowered.

Lift 2 includes position sensors 24 and 26. Each position sensor 24 and 26 is operable to sense the vertical position of the respective superstructure. This may be done by directly sensing the moving component of the actuator, such as in the depicted embodiment a cylinder piston rod, sensing vertical position of the superstructure, or sensing any lift component whose position is related to the position of the superstructure. Recognizing that the position and movement of the superstructures may be determined without direct reference to the superstructures, as used herein, references to the position or movement of a superstructure are also references to the position or movement of any lift component whose position or movement is indicative of the position or movement of a superstructure, including for example the actuators.

Position sensors 24 and 26 are illustrated as string potentiometers, which generate analog signals that are converted to digital signals for processing. Any position measuring sensor having adequate resolution may be used in the teachings of this invention, including by way of non-limiting examples, optical encoders, LVDT, displacement laser, photo sensor, sonar displacement, radar, etc. Additionally, position may be sensed by other methods, such as by integrating velocity over time. As used herein, position sensor includes any structure or algorithm capable of generating a signal indicative of position.

Lift 2 includes controller 28 which includes an interface configured to receive position signals from position sensors 24 and 26, and to generate movement control signals to control the movement of the superstructures. Movement control signals control the movement of the superstructures by controlling or directing the operation, directly or indirectly, of the lift components (in the depicted embodiment, the actuators) which effect the movement of the superstructure. Controller 28 is connected to first and second flow control valves 12 and 14, isolation check valve 18, lowering valve 22 and pump motor 30, and includes the appropriate drivers on driver board 32 to actuate them. Controller 28 is illustrated as receiving input from other lift sensors (as detailed in copending application Ser. No. 10/055,800), controlling the entire lift operation. It is noted that controller 28 may be a stand alone controller (separate from the lift controller which controls the other lift functions) dedicated only to controlling the movement of the superstructures in response to a command from a lift controller.

In the depicted embodiment, controller 28 includes a computer processor which is configured to execute the software implemented control algorithms every 10 milliseconds. Controller 28 generates movement control signals which control the operation of first and second flow control valves 12 and 14 to allow the required flow volume to the respective actuators 4 and 6 to synchronize the vertical actuation of the pair of superstructures.

Figure 2:
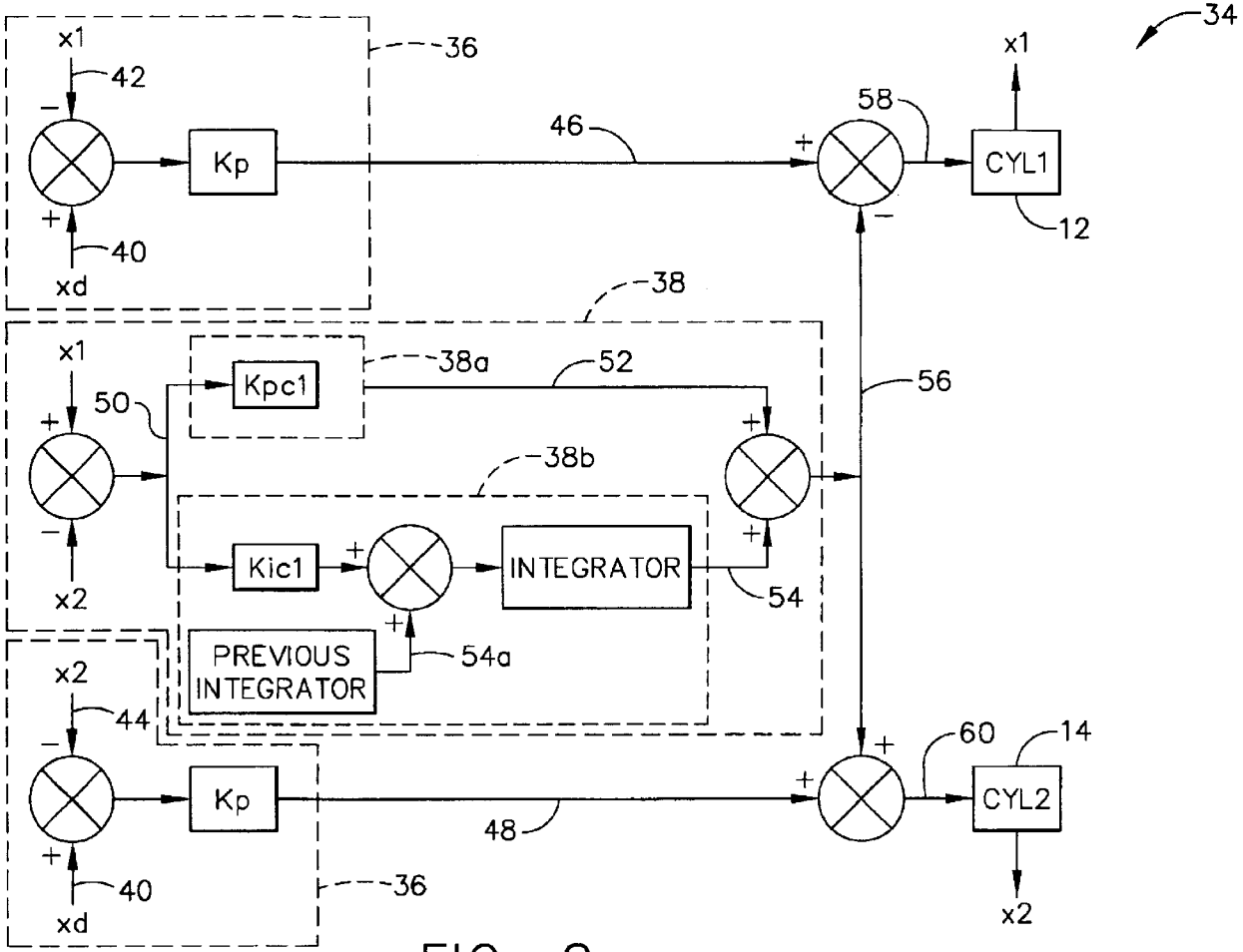
FIG. 2 is a control diagram showing the complete raise control including the raise circuit and the position synchronization circuit for a pair of superstructures.

FIG. 2 is a control diagram showing the complete raise control, generally indicated at 34, including raise circuit 36 and position synchronization circuit 38 for the pair of superstructures. When the lift is instructed to raise the superstructures, complete raise control 34 effects the controlled, synchronized movement of the superstructures based on input from position sensors 24, 26. Raise circuit 36 is a feed back control loop which is configured to command the pair of superstructures to an upward vertical trajectory. Raise circuit 36 compares the desired position of the superstructures indicated by vertical trajectory signal 40 (xd) to the actual positions indicated respectively by position signals 42 and 44 (x1 and x2) generated by position sensors 24, 26. The respective differences between each set of two signals, representing the error between the desired position and the actual position, is multiplied by a raise gain factor Kp, to generate first raise signal 46 for the first superstructure and second raise signal 48 for the second superstructure, respectively. Although in the depicted embodiment, Kp was the same for each superstructure, alternatively Kp could be unique for each.

In the embodiment depicted, vertical trajectory signal 40 is a linear function of time, wherein the desired position xd is incremented a predetermined distance for each predetermined time interval. It is noted that the vertical trajectory may be any suitable trajectory establishing the desired position of the superstructures (directly or indirectly) based on any relevant criteria. By way of non-limiting example, it may be linear or non-linear, it may be based on prior movement or position, or the passage of time. Alternatively, first and second raise signals 46 and 48 could be fixed signals, independent of the positions of the superstructures.

The vertical trajectory signal resets when the lift is stopped and restarted. Thus, if the upward motion of the lift is stopped at a time when the actual position of the lift lags behind the desired position as defined by the vertical trajectory signal 40, upon restarting the upward motion, the vertical trajectory signal 40 starts from the actual position of the superstructures.

There are various ways to establish the starting position from which the vertical trajectory signal is initiated. In the depicted embodiment, one of the posts is considered a master and the other is considered slave. When the lift is instructed to raise, the actual position of the superstructures of the master post is used as the starting position from which the vertical trajectory signal starts. Of course, there are other ways in which to establish the starting position of the vertical trajectory signal, such as the average of the actual positions of the two posts.

In the embodiment depicted, vertical trajectory signal 40 is generated by controller 28. Alternatively vertical trajectory signal 40 could be received as an input to controller 28, being generated elsewhere.

Position synchronization circuit 38, a differential feedback control loop, is configured to synchronize the vertical actuation/movement of the pair of superstructures during raising. In the depicted embodiment, position synchronization circuit 38 is a cross coupled proportional-integral controller which generates a single proportional-integral error signal relative to the respective vertical positions of the superstructures. As shown, position synchronization circuit 38 includes proportional control 38*a* and integral control 38*b*, both of which start with the error between the two positions, x1 and x2, indicated by 50. Output 52 of proportional control 38*a* is the error 50 multiplied by a raise gain factor Kpc1. Output 54 of integral control 38*b* is the error 50 multiplied by a raise gain factor Kic1, summed with the integral output 54*a* of integral control 38*b* from the preceding execution of integral control 38*b*. Output 52 and output 54 are summed to generate proportional-integral error signal 56.

Controller 28, in response to first raise signal 46 and proportional-integral error signal 56, generates a first movement control signal 58 for the first superstructure. In the depicted embodiment, first movement control signal 58 is generated by subtracting proportional-integral error signal 56 from first raise signal 46. First movement control signal 58 controls, in this embodiment, first flow control valve 12 so as to effect the volume of fluid flowing to and therefore the operation of first actuator 4 and, concomitantly, the first superstructure.

Controller 28, in response to second raise signal 48 and proportional-integral error signal 56, generates a second movement control signal 60 for the second superstructure. In the depicted embodiment, second movement control signal 60 is generated by adding proportional-integral error signal 56 to second raise signal 48. Second movement control signal 60 controls, in this embodiment, second flow control valve 14 so as to effect the volume of fluid flowing to and therefore the operation of second actuator 6 and, concomitantly, the second superstructure.

Figure 3:
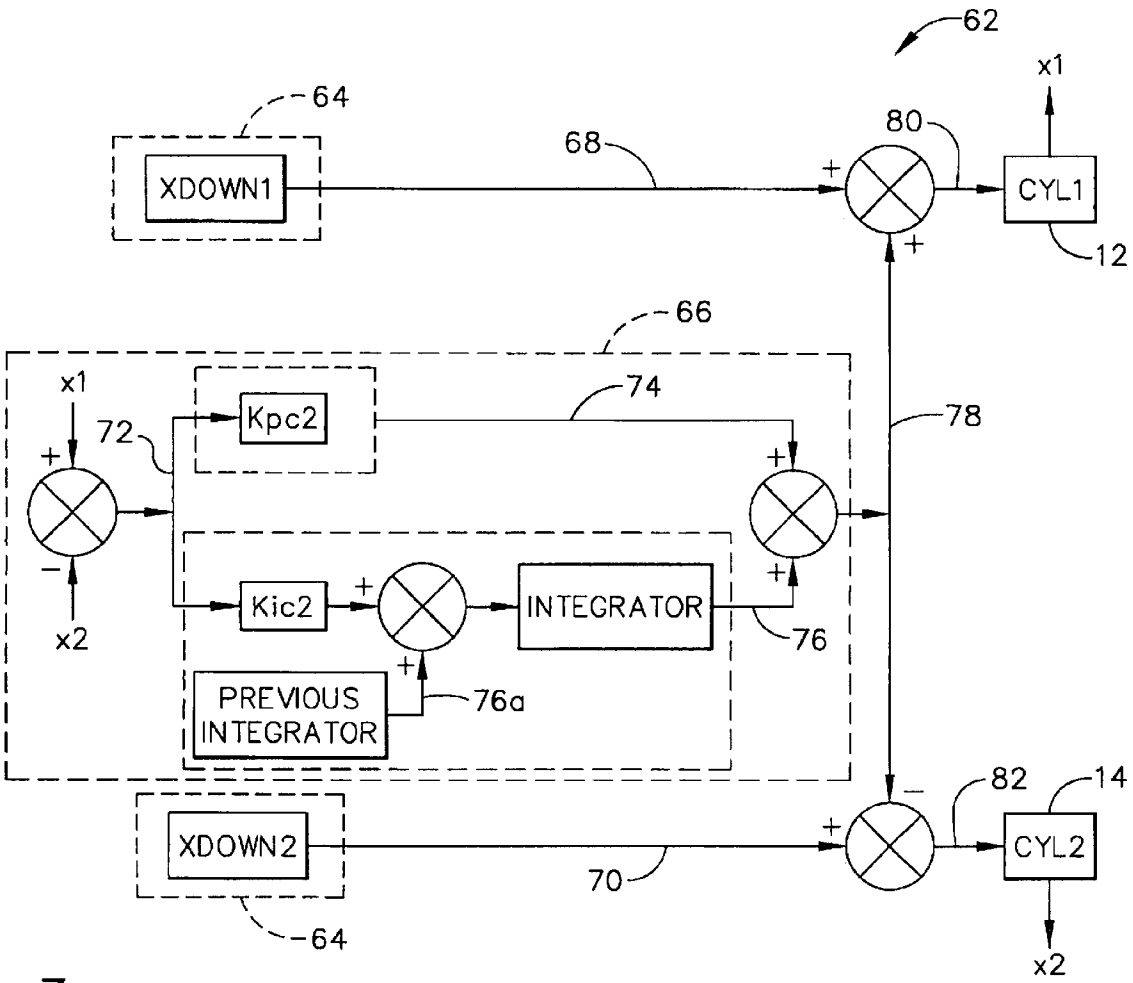
FIG. 3 is a control diagram showing the complete lower control including the lowering circuit and the position synchronization circuit for a pair of vertically superstructures

FIG. 3 is a control diagram showing the complete lower control, generally indicated at 62, including lowering circuit 64, and position synchronization circuit 66, a differential feedback control loop, for the pair of superstructures. When the lift is instructed to lower the superstructures, complete lower control 62 effects the controlled movement of the superstructures.

Lowering circuit 64 is configured to generate first lowering signal 68 for the first superstructure and to generate second lowering signal 70 for the second superstructure. In the depicted embodiment, lowering signals are constant, not varying in dependence with the positions of the superstructures or time. Although in the depicted embodiment, lowering signals 68 and 70 are equal, they could be unique for each superstructure. Lowering signals 68 and 70 may alternatively be respectively generated in response to the positions of the superstructures, such as based on the differences between a vertical trajectory and the actual positions.

Position synchronization circuit 66 is similar to position synchronization circuit 38. Position synchronization circuit 66 is configured to synchronize the vertical actuation/movement of the pair of superstructures during lowering. In the depicted embodiment, position synchronization circuit 66 is a cross coupled proportional-integral controller which generates a single proportional-integral error signal relative to the respective vertical positions of the superstructures. As shown, position synchronization circuit 66 includes proportional control 66*a* and integral control 66*b*, both of which start with the error between the two positions, x1 and x2, indicated by 72. Output 74 of proportional control 66*a* is the error 72 multiplied by a lowering gain factor Kpc2. Output 76 of integral control 66*b* is the error 72 multiplied by a lowering gain factor Kic2, summed with the integral output 76*a* of integral control 66*b* from the preceding execution of integral control 66*b*. Output 74 and output 76 are summed to generate proportional-integral error signal 78.

Controller 28, in response to first lowering signal 68 and proportional-integral error signal 78, generates a first movement control signal 80 for the first superstructure. In the depicted embodiment, first movement control signal 80 is generated by adding proportional-integral error signal 78 to first lowering signal 68. First movement control signal 80 controls, in this embodiment, first flow control valve 12 so as to effect the volume of fluid flowing from and therefore the operation of first actuator 4 and, concomitantly, the first superstructure.

Controller 28, in response to second lowering signal 70 and proportional-integral error signal 78, generates a second movement control signal 82 for the second superstructure. In the depicted embodiment, second movement control signal 82 is generated by subtracting proportional-integral error signal 78 from second lowering signal 70. Second movement control signal 82 controls, in this embodiment, second flow control valve 14 so as to effect the volume of fluid flowing from and therefore the operation of second actuator 6 and, concomitantly, the second superstructure.

The present invention is also applicable to lifts having more than one pair of superstructures. For example, this invention may be used on a four post lift which has two pairs of superstructures, each pair comprising a left and right side of a respective end of the lift or each pair comprising the left side and the right side of the lift. The invention may used with an odd number of superstructures, such as by treating one of the superstructures as being a pair "locked" together. More than two pairs may be used, with one of the pairs being the control or target pair.

For a four post lift, the controller includes an interface configured to receive first and second position signals of the first pair, and to receive third and fourth positions signals of the second pair. The complete up control and complete down control as described above are used for each pair (first and second superstructures; third and fourth superstructures). The respective gain factors between the pairs, or between any superstructures, may be different. Differences in the hydraulic circuits (such as due to different hydraulic hose lengths) can result in the need or use of different gain factors.

The controller is further configured to synchronize the first and second pairs relative to each other through a lift position synchronization control which in the depicted embodiment reduces the difference between the average of the positions of the first pair and the mean of the positions of the second pair.

Figure 4:
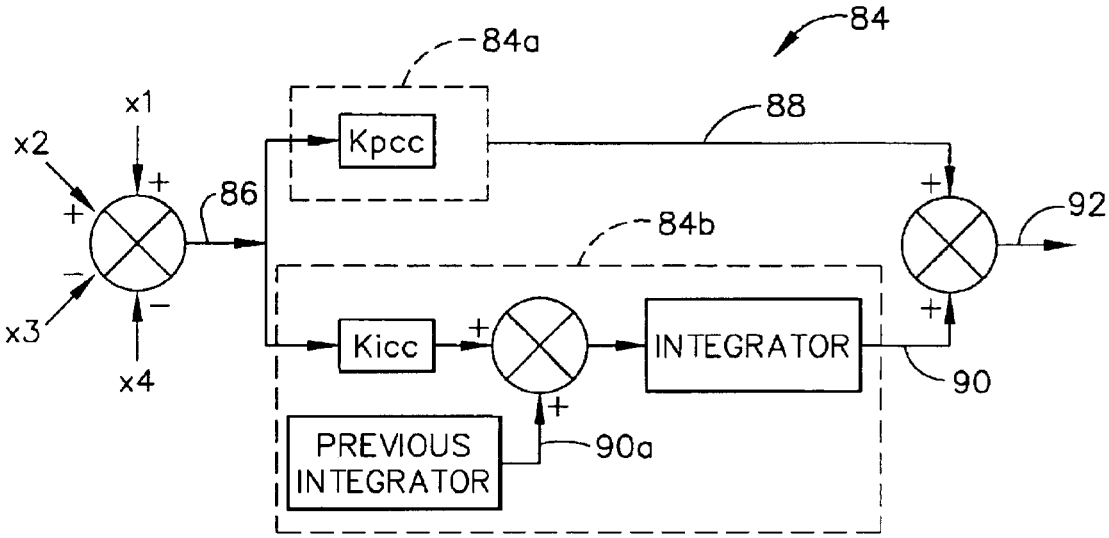
FIG. 4 is a control diagram showing the lift position synchronization circuit for two pairs of superstructures.

FIG. 4 is a control diagram showing the lift position synchronization circuit, a differential feedback control loop, generally indicated at 84, for synchronizing the two pairs during raising. As shown, lift position synchronization circuit 84 includes proportional control 84*a* and integral control 84*b*, both of which start with the error, indicated by 86, between the first pair and the second pair by subtracting the positions of the second pair, x3 and x4, from the positions of the first pair, x1 and x2. Output 88 of proportional control 84*a* is the error 86 multiplied by a raise gain factor Kpcc. Output 90 of integral control 84*b* is the error 86 multiplied by a raise gain factor Kicc, summed with the integral output 90*a* integral control 84*b* from the preceding execution of integral control 84*b*. Output 88 and output 90 are summed to generate lift proportional-integral error signal 92.

Figure 5:
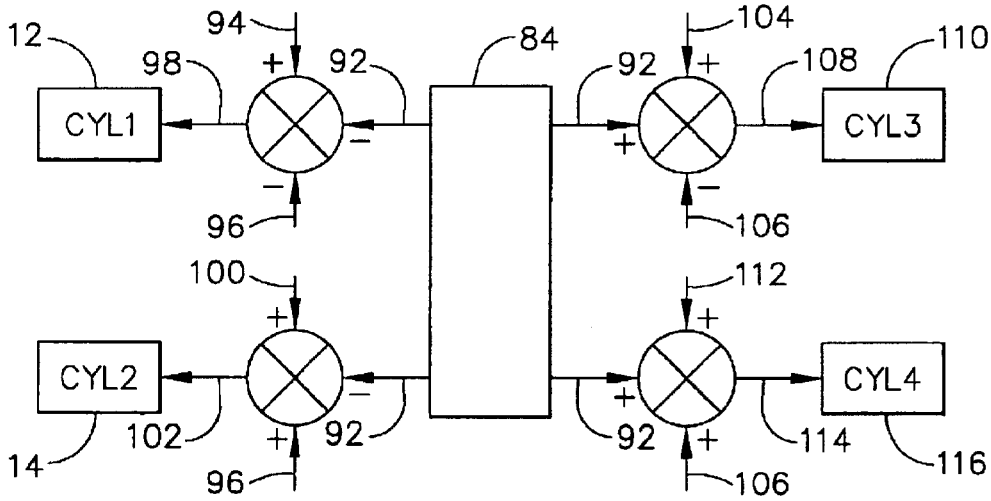
FIG. 5 is a control diagram illustrating the generation of movement control signals for raising each superstructure of each of two pairs.

FIG. 5 is a control diagram illustrating the generation of movement control signals for raising each superstructure of each of the two pairs. The controller, in response to first raise signal 94, first pair proportional-integral error signal 96 and lift proportional-integral error signal 92, generates a first movement control signal 98 for the first superstructure. In the depicted embodiment, first movement control signal 98 is generated by subtracting lift proportional-integral error signal 92 and first pair proportional-integral error signal 96 from first raise signal 94. First movement control signal 98 controls, in this embodiment, first flow control valve 12 so as to effect the volume of fluid flowing to and therefore the operation of first actuator 4 and, concomitantly, the first superstructure.

The controller, in response to second raise signal 100, first pair proportional-integral error signal 96 and lift proportional-integral error signal 92, generates a second movement control signal 102 for the second superstructure. In the depicted embodiment, second movement control signal 102 is generated by adding subtracting lift proportional-integral error signal 92 from the sum of first pair proportional-integral error signal 96 and first raise signal 100. Second movement control signal 102 controls, in this embodiment, second flow control valve 14 so as to effect the volume of fluid flowing to and therefore the operation of second actuator 6 and, concomitantly, the second superstructure.

Still referring to FIG. 5, the controller, in response to third raise signal 104, second pair proportional-integral error signal 106 and lift proportional-integral error signal 92, generates a third movement control signal 108 for the third superstructure. In the depicted embodiment, third movement control signal 108 is generated by subtracting second pair proportional-integral error signal 106 from the sum of lift proportional-integral error signal 92 and third raise signal 104. Third movement control signal 108 controls, in this embodiment, third flow control valve 110 so as to effect the volume of fluid flowing to and therefore the operation of the third actuator (not shown) and, concomitantly, the third superstructure.

The controller, in response to fourth raise signal 112, second pair proportional-integral error signal 106 lift proportional-integral error signal 92, generates a fourth movement control signal 114 for the fourth superstructure. In the depicted embodiment, fourth movement control signal 114 is generated by summing fourth raise signal 112, second pair proportional-integral error signal 106 and lift proportional-integral error signal 92. Fourth movement control signal 114 controls, in this embodiment, fourth flow control valve 116 so as to effect the volume of fluid flowing to and therefore the operation of the fourth actuator (not shown) and, concomitantly, the fourth superstructure.

During lowering, the controller executes the lift position synchronization algorithm as shown in FIG. 4, except that the lowering gain factors are not necessarily the same as the raise gain factors. In the depicted embodiment, the lowering gain factors were different from the raise gain factors. During lowering, in the depicted embodiment, the arithmetic operations are reversed for the lift proportional-integral error signal: The lift proportional-integral error signal is added to generate the first and second movement signals (instead of subtracted as shown in FIG. 5) and subtracted to generate the third and fourth movement signals (instead of added as shown in FIG. 5).

The gain factors described above may be set using any appropriate method, such as the well known Zigler-Nichols tuning methods, or empirically. In determining the gain factors empirically, the integral control was disabled and multiple cycles of different loads were raised and lowered to find the optimum gain factor for the proportional control. The integral control was then enabled and those gain factors determined through multiple cycles of different loads.

The following table sets forth two examples of the gain factors and up rate:

| | Example 1 | Example 2 |
|---|---|---|
| Kp | 1.0 | 6.0 |
| Kpc1 | 0.5 | 6.0 |
| Kic1 | 0.15 | 0.3 |
| Kpc2 | 1.5 | 6.0 |
| Kic2 | 0.25 | 0.25 |
| Xdown1 | 65 | 50 |
| Xdown2 | 175 | 175 |
| up rate | 2.0 in/sec | 1.8 in/sec |

It is noted, as seen above, that gain factors may be 1.

The controller preferably includes a calibration algorithm for the position sensors. In the depicted embodiment, whenever the lift is being commanded to move when it is near either end of its range of travel and the position sensors do not indicate movement for a predetermined period of time, the calibration algorithm is executed. In such a situation, it is assumed that the lift is at the end of its range of travel. The algorithm correlates the position sensor output as corresponding to the maximum or minimum position of the lift, as appropriate. The inclusion of a calibration algorithm allows a range of position sensor locations, reducing the manufacturing cost.

Figure 6:
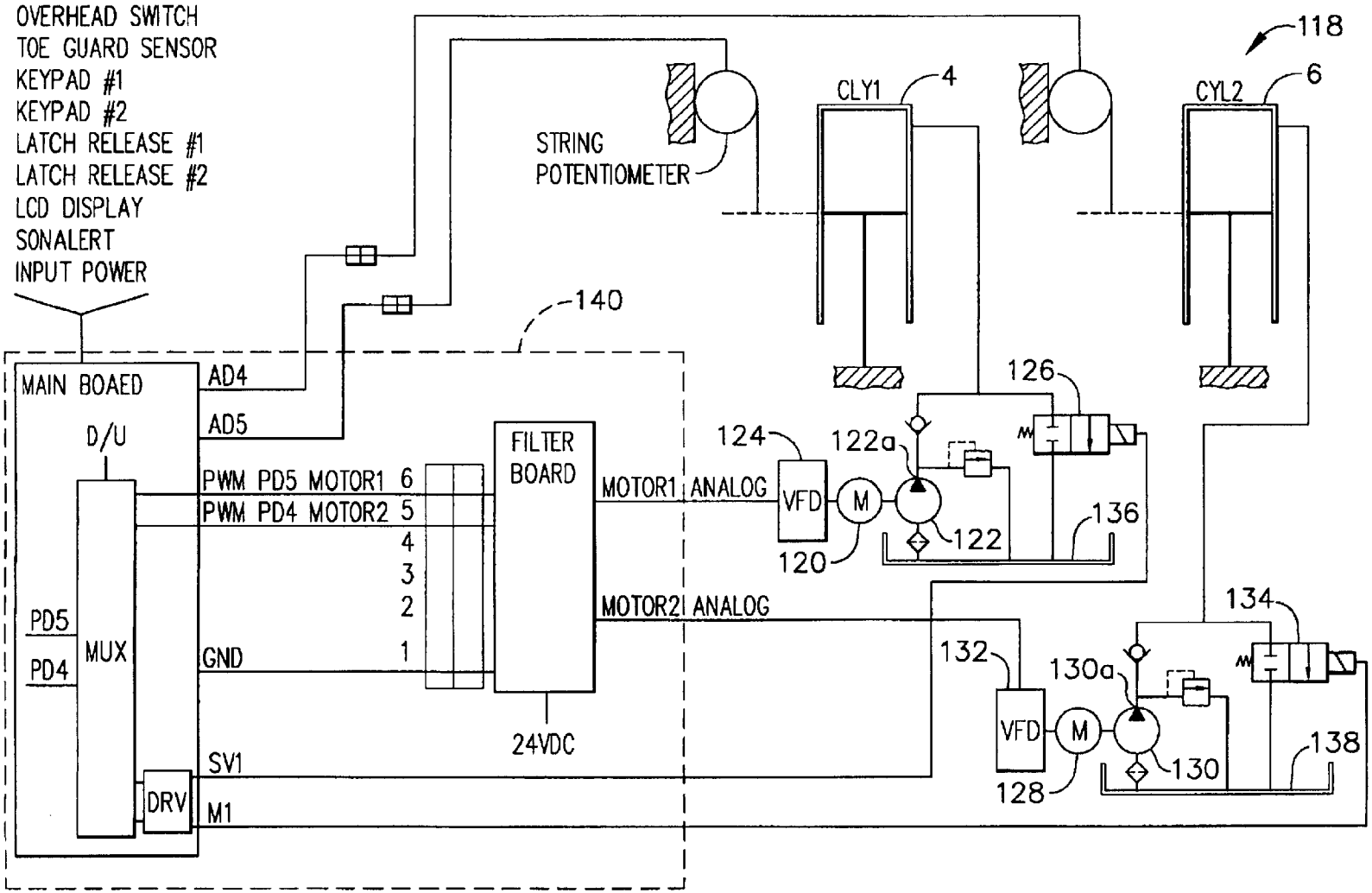
FIG. 6 is a schematic diagram of another embodiment of a control in accordance with the present invention showing the controller and a different hydraulic circuit different from that of FIG. 1.

The present invention may be used with a variety of actuators and hydraulic circuits. FIG. 6 illustrates an alternate embodiment of the hydraulic circuit. In this vehicle lift, generally indicated at 118, the difference in comparison to FIG. 1 lies in that control of the flow of hydraulic fluid to actuators 4 and 6 is accomplished through the use of individual motors 120 and 128 and pumps 122 and 130 for each superstructure, with each motor/pump being controlled by a respective variable frequency drive (VFD) motor controller 124 and 132 to effect raising the lift and through the use of respective proportioning flow control valves 126 and 134 to effect lowering the lift. Alternatively, individual motors 120, 128 could drive a screw type actuator.

As illustrated, each motor/pump 120/122 and 128/130 has a respective associated source of hydraulic fluid 136 and 138, although a single source could be associated with both motors and pumps. Each pump 122 and 130 has a respective discharge 122*a* and 130*a* which is in fluid communication with its respective actuator 4 and 6.

Controller 140 includes the appropriate drivers for the VFD motor controllers 124 and 132, and executes the control algorithms as described above to synchronize the vertical actuation of the superstructures. By varying the speed of the respective motors 120 and 132, the hydraulic fluid flow rate to the respective actuators 4 and 6 varies for raising.

Figure 7:
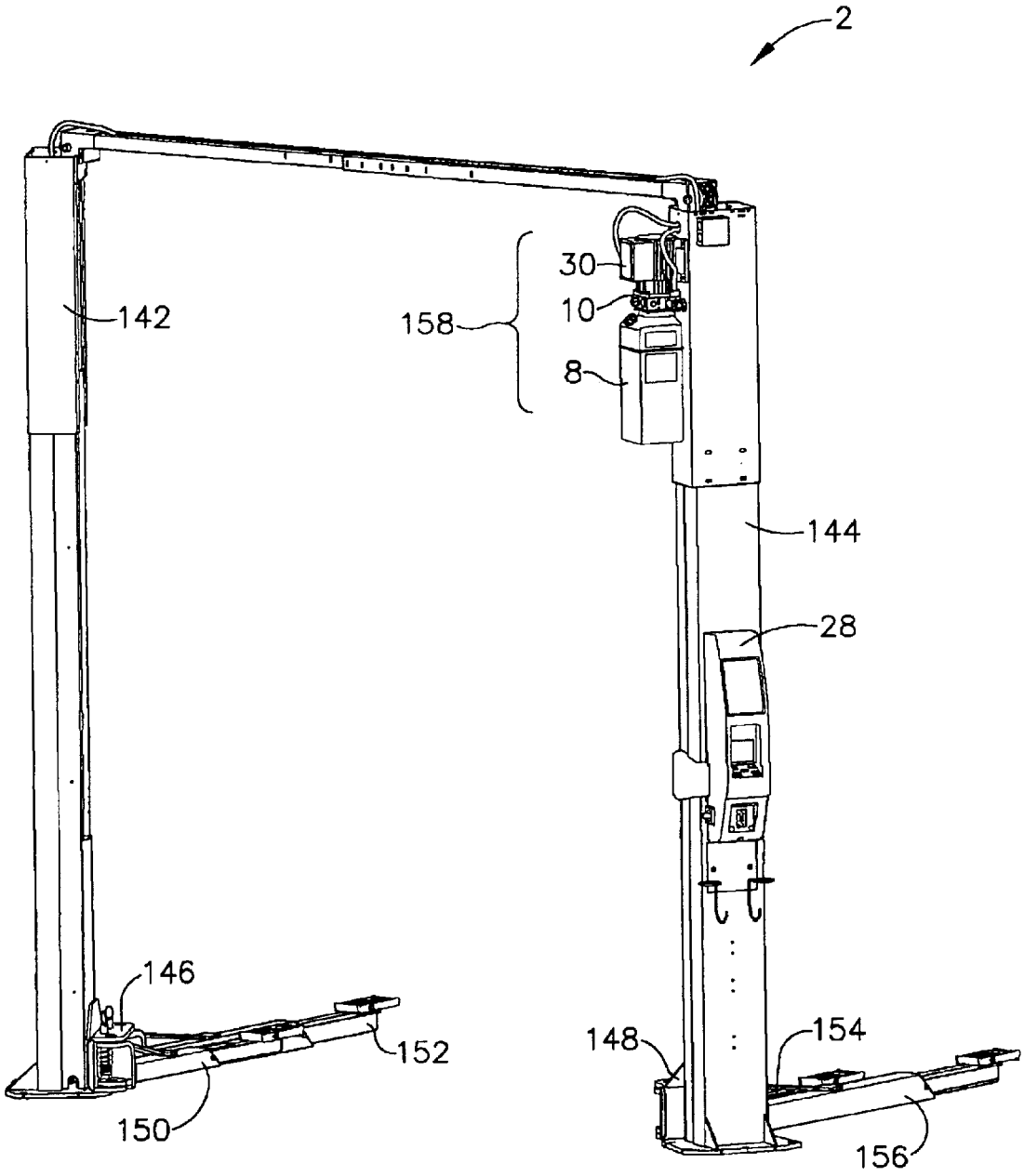
FIG. 7 is a perspective view of a two post vehicle lift.

FIG. 7 illustrates a perspective view of an asymmetric two post vehicle lift generally indicated at 2, depicting a two post lift on which the controller and hydraulic circuit depicted in FIG. 1 may utilized. Although an asymmetric two post lift is illustrated, the present invention is not limited to such. Lift 2 includes two spaced apart columns or posts 142 and 144. Each post 142, 144 carries a respective carriage 146, 148 which is moveable vertically along respective posts 142, 144. Extending from each carriage 146, 148 are two respective arms 150, 152, 154, 156. Carriages 146 and 148, and concomitantly arms 150, 152, 154 and 156, are respectively moved by independently by actuators 4 and 6 (not shown in FIG. 7), and respectively comprise the first and second superstructures described above. As described above, lift 2 includes reservoir 8 pump 10, and motor 30 which functions, in response to controller, generally indicated at 28. control, to raise and lower arms 8.

Figure 8:
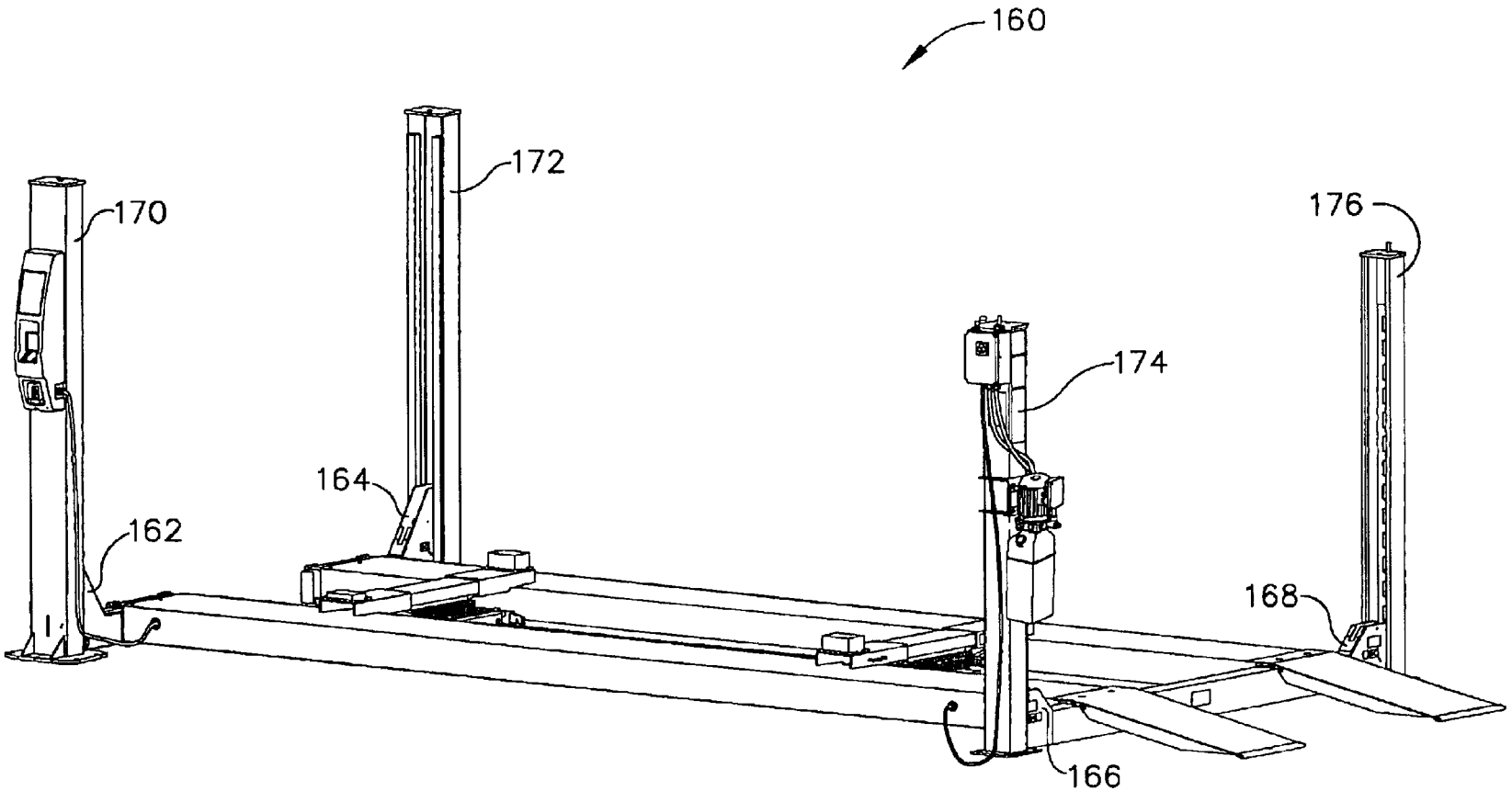
FIG. 8 is a perspective view of a four post vehicle lift.

FIG. 8 illustrates a perspective view of a four post vehicle lift, generally indicated at 1600. Lift 160 has two pairs of vertically moveable superstructures 162, 164, 166, 168 carried respectively by one of four spaced apart columns or posts 170, 172, 174, 176, 178. Four post lift 160 includes two runways which are supported by the moveable superstructures.

In summary, numerous benefits have been described which result from employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A hydraulic fluid control system for a vehicle lift comprising:

a. at least one source of hydraulic fluid;

b. a first hydraulic actuator configured to move a first vertically moveable superstructure, said first hydraulic actuator being in fluid communication with said at least one source of hydraulic fluid;

c. a second hydraulic actuator configured to move a second vertically moveable superstructure, said second hydraulic actuator being in fluid communication with said at least one source of hydraulic fluid;

d. a first proportional flow control valve interposed between said at least one source of hydraulic fluid and said first hydraulic actuator;

e. a second proportional flow control valve interposed between said at least one source of hydraulic fluid and said second hydraulic actuator;

f. said first proportional flow control valve and said second proportional flow control valve each being independently controllable relative to each other; and g. a controller connected to said first and second proportional flow control valves for controlling flow of said hydraulic fluid to said first and second hydraulic actuators.

2. The hydraulic fluid control system of claim 1, wherein said at least one source of hydraulic fluid comprises a first and second source of hydraulic fluid, said first hydraulic actuator being in fluid communication with said first source and said second hydraulic actuator being in fluid communication with said second source.

3. The hydraulic fluid control system of claim 1, wherein no hydraulic fluid between either of said first proportional flow control valve and said first hydraulic actuator and said second proportional flow control valve and said second hydraulic actuator is bled off.

4. The hydraulic fluid control system of claim 1, wherein control of the flow of hydraulic fluid to said first and second hydraulic actuators is controlled solely by said first and second proportional flow control valves, respectively.

5. A hydraulic fluid control system for a vehicle lift comprising:

a. a first hydraulic actuator configured to move a first vertically moveable superstructure, said first hydraulic actuator being in fluid communication with a source of hydraulic fluid associated with said first hydraulic actuator;

b. a first pump having a first discharge, said first discharge being in fluid communication with said first hydraulic actuator;

c. a second hydraulic actuator configured to move a second vertically moveable superstructure, said second hydraulic actuator being in fluid communication with an associated source of hydraulic fluid;

d. a second pump having a second discharge, said second discharge being in fluid communication with said second hydraulic actuator; and e. a controller connected to said first and second pumps for controlling the respective speeds of said first and second pumps variably, whereby flow of said hydraulic fluid to said first and second hydraulic actuators is controlled.

6. The vehicle lift of claim 5, wherein said source of hydraulic fluid associated with said first hydraulic actuator and said source of hydraulic fluid associated with said second hydraulic actuator are the same source.

* * * * *